US009707443B2

(12) United States Patent
Warren

(10) Patent No.: US 9,707,443 B2
(45) Date of Patent: Jul. 18, 2017

(54) EXERCISE DEVICE

(71) Applicant: THE SPOKE HOUSE LIMITED, Freemans Bay, Auckland (NZ)

(72) Inventor: Simon Corbould Warren, Auckland (NZ)

(73) Assignee: The Spoke House Limited, Auckland (NZ)

( * ) Notice: Subject to any disclaimer, the term of this patent is extended or adjusted under 35 U.S.C. 154(b) by 341 days.

(21) Appl. No.: 14/093,149

(22) Filed: Nov. 29, 2013

(65) Prior Publication Data

US 2014/0087923 A1 Mar. 27, 2014

Related U.S. Application Data

(63) Continuation-in-part of application No. PCT/IB2012/052685, filed on May 30, 2012.

(51) Int. Cl.
*A63B 23/04* (2006.01)
*A63B 22/06* (2006.01)
(Continued)

(52) U.S. Cl.
CPC ..... *A63B 23/0476* (2013.01); *A63B 22/0605* (2013.01); *A63B 22/16* (2013.01);
(Continued)

(58) Field of Classification Search
CPC ..... A63B 22/00; A63B 22/06; A63B 22/08; A63B 22/10; A63B 22/12; A63B 69/00; A63B 69/16; A63B 22/0605; A63B 21/225; A63B 2225/09; A63B 2225/093; A63B 21/015; A63B 22/0046; A63B 23/0476; A63B 22/0664; A63B 2022/0652; A63B 22/001; A63B 2022/0658; A63B 2022/0641; A63B 21/00069;
(Continued)

(56) References Cited

U.S. PATENT DOCUMENTS 2,145,940 A * 2/1939 Marlowe ..... A63B 22/0076 482/112
2,320,489 A * 6/1943 Turner ..... A61H 1/0214 482/63
(Continued)

FOREIGN PATENT DOCUMENTS

CN 201612977 U 10/2010

OTHER PUBLICATIONS

PCT International Search Report and Written Opinion for PCT/IB2012/052685 mailed Sep. 14, 2012; 10 pages.
(Continued)

*Primary Examiner* — Andrew S Lo
(74) *Attorney, Agent, or Firm* — Morrison & Foerster LLP

(57) ABSTRACT

A user mountable stationary exercise device comprising, a base and a frame pivotally supported by the base such that the frame can pivot relative to the base about a pivot axis. The device also comprises a user actuated pedal arrangement supported by the frame and operatively connected to drive a wheel. In use, a user may mount the frame and apply force to the pedal arrangement to drive the wheel, and/or the frame to cause the frame to pivot relative to the base about the pivot axis.

31 Claims, 13 Drawing Sheets

(51) Int. Cl.

| | |
|---|---|
| ***A63B 22/16*** | (2006.01) |
| ***A63B 26/00*** | (2006.01) |
| *A63B 21/005* | (2006.01) |
| *A63B 21/008* | (2006.01) |
| *A63B 21/012* | (2006.01) |
| *A63B 21/22* | (2006.01) |
| *A63B 71/00* | (2006.01) |

(52) U.S. Cl.
CPC ..... *A63B 26/003* (2013.01); *A63B 21/005* (2013.01); *A63B 21/0088* (2013.01); *A63B 21/012* (2013.01); *A63B 21/225* (2013.01); *A63B 2022/0641* (2013.01); *A63B 2071/0072* (2013.01)

(58) Field of Classification Search
CPC ..... A63B 2022/067; A63B 21/1496; A63B 2210/50; A63B 22/0012
USPC ..... 482/57–65; 280/205
See application file for complete search history.

(56) References Cited

U.S. PATENT DOCUMENTS 5,011,133 A * 4/1991 Myers, Sr. ..... A63G 1/22 472/21
5,035,418 A * 7/1991 Harabayashi ..... A63B 22/0023 482/57
5,240,417 A 8/1993 Smithson et al.
5,364,271 A 11/1994 Aknin et al.
5,527,248 A * 6/1996 Crivello ..... A61H 1/0292 482/133
5,853,353 A * 12/1998 Blumel ..... A61H 1/0214 482/142
6,551,219 B1 * 4/2003 Brown ..... A63B 22/0605 482/142
6,692,411 B1 * 2/2004 Stearns ..... A63B 21/068 482/57
6,926,645 B1 * 8/2005 Stearns ..... A63B 22/0012 482/57
7,081,070 B1 7/2006 Washington et al.
7,998,032 B2 * 8/2011 Schroeder ..... A63B 69/16 482/61
8,784,221 B1 * 7/2014 Bishop ..... A63G 1/12 472/21
8,845,493 B2 * 9/2014 Watterson ..... A63B 22/02 482/1
2001/0031686 A1 * 10/2001 Ware ..... A63B 21/015 482/57
2002/0004439 A1 * 1/2002 Galbraith ..... A63B 22/0605 482/57
2002/0016236 A1 * 2/2002 Stearns ..... A63B 21/068 482/57
2002/0055422 A1 * 5/2002 Airmet ..... A63B 22/16 482/61
2005/0275189 A1 * 12/2005 Giordanella ..... B62K 5/00 280/239
2006/0108156 A1 * 5/2006 Heinzmann ..... B60L 11/007 180/8.2
2007/0049467 A1 * 3/2007 Lin ..... A63B 21/015 482/57
2008/0067765 A1 * 3/2008 Chavis ..... B62H 1/12 280/32.7
2009/0048076 A1 * 2/2009 Irving ..... A63B 21/015 482/57
2009/0085320 A1 * 4/2009 Fraser ..... B62K 1/00 280/205
2010/0062908 A1 * 3/2010 Hamilton ..... A63B 24/0087 482/61
2010/0096833 A1 4/2010 Gray
2010/0298103 A1 * 11/2010 Hamilton ..... A63B 24/0087 482/63
2011/0105282 A1 * 5/2011 Pinzon ..... A63B 22/0605 482/57
2013/0277941 A1 * 10/2013 Ryan ..... B62K 15/008 280/278
2014/0024502 A1 * 1/2014 Watterson ..... A63B 22/0605 482/57
2014/0148312 A1 * 5/2014 Lo ..... A63B 22/0605 482/57
2014/0221158 A1 * 8/2014 Mabey ..... A63B 21/0088 482/4

OTHER PUBLICATIONS

International Preliminary Report on Patentability received for PCT Patent Application No. PCT/IB2012/052685, mailed on Dec. 2, 2013, 8 pages.

* cited by examiner

EXERCISE DEVICE

FIELD OF INVENTION

The present invention relates to exercise devices.

BACKGROUND OF THE INVENTION

Exercise bicycles (also known as stationary bicycles or exercycles) are well known. They are usually equipped with a seat, pedals and handlebars just like a bicycle. However they have a fixed base that is stationary, and are therefore used for exercise rather than transportation.

A bicycle "wheelie" or wheel stand is a manoeuvre in which the front wheel of the bicycle can be lifted off the ground due to a large torque simultaneously being applied to the rear wheel. A sustained "wheelie" is a difficult manoeuvre because the rider is required to balance solely on the rear wheel. This balancing requires skill and consumes energy. Combining the skill and energy consumption benefits of a normal bike wheelie but with a stationary exercycle could be beneficial to allow a person exercising to exert more energy and/or exercise in a different manner.

It is therefore an object of the present invention to provide an exercise device that enhances the workout experience of a person compared to current fixed forms of exercycles, or which at least provides the public with a useful choice.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

For the purposes of this specification, the term "exercise device" shall be construed to mean a general term for a wide range of devices that could be used for the purpose of exercise, training, or any other physical activity.

BRIEF DESCRIPTION OF THE INVENTION

In a first aspect the present invention consists in a user mountable stationary exercise device comprising, a base, a frame pivotally supported by the base such that the frame can pivot relative to the base about a pivot axis, a user actuated pedal arrangement supported by the frame and operatively connected to drive a wheel that has a rotational axis coaxial with said pivot axis, and a seat to support a user that remains at a substantially constant angle relative to the base, by a seat tilting mechanism, when the frame is pivoted, wherein, in use, a user may mount said frame and apply force to 1. the pedal arrangement to drive said wheel, and
2. the frame to cause the frame to pivot relative to the base about said pivot axis.

Preferably said frame can pivot about said pivot axis between a lowered frame condition wherein it is vertically supported at said pivot axis and at one other location in a "wheelie" condition where the frame is supported only at said pivot axis.

Preferably wherein the frame is pivotally mounted relative to said base at a first, horizontal, axis to allow the frame to rear up and drop down relative to said base.

Preferably the wheel is mounted by said frame to rotate about an axis (herein after "wheel axis") parallel to the first axis.

Preferably the wheel is a flywheel with a perimeter distal from its rotational axis at where the flywheel mass is distributed. The stationary exercise device of claim 1 wherein the wheel is a flywheel with a perimeter distal from its rotational axis at where mass of at least 4 kg is distributed.

Preferably the wheel is a flywheel with a perimeter distal from its rotational axis at where mass of at least 4 kg is distributed, the perimeter not being more than 400 m from the rotational axis.

Preferably the seat is pivotally mounted at a seat mount of the frame.

Preferably the seat mount is a seat stem and said seat is pivotally mounted at a distal end said seat stem.

Preferably a seat pivot controller is provided to cause the seat to pivot relative the seat mount when the frame is caused to pivot relative to the base about said pivot axis.

Preferably the seat pivot controller adjusts the seat angle relative the frame as a result of relative rotation of the frame to the base.

Preferably the seat pivot controller operatively extends between the base at a location away from the pivot axis and the seat at a location away from where the seat is pivotally mounted to said seat mount.

Preferably seat pivot controller forms part of a 4 bar linkage mechanism operative between the seat, frame and base to passively adjust the angle of the seat relative the frame dependent on angle between the frame and the base.

Preferably pivot controller comprises a bar that extends between and is pivotally connected to the seat at one end and the frame at the other end.

Preferably the bar is able to be adjusted in length.

Preferably the seat stem is able to be adjusted in length.

Preferably the pivot controller comprises a push/pull Bowden cable system.

Preferably the pivot controller comprises an actuator coupled between said seat and said frame.

Preferably the pivot controller also comprises an actuator coupled between said frame and said base and is operatively connected to said first mentioned actuator to cause it to move dependent on movement between the frame and the base.

Preferably the seat is pivotally mounted relative said frame, the seat passively adjusted in angle relative the frame by virtue of a 4 bar linkage mechanism operative between the seat, frame and base.

Preferably the first axis and the wheel axis are coaxial.

Preferably the pedal arrangement includes, for each foot of the user, a crank and pedal rotationally mounted to said frame by a crank axle.

Preferably the crank axle axis of rotation and wheel axis are parallel to each other.

Preferably the wheel can be subjected to resistance braking.

Preferably the resistance braking is effected by a resistance brake mechanism that is operable by the user and can vary the work rate of the user.

Preferably the resistance brake mechanism includes a friction brake.

Preferably the friction brake can operate at a location of the wheel away from its axis of rotation.

Preferably the resistance brake mechanism is a magnetic brake that can operate at a location of the wheel away from its axis of rotation.

Preferably the resistance brake mechanism can cause the establishing of a biasing force between the wheel and the frame to cause to frame to move downwards toward the ground.

Preferably the wheel is a flywheel.

Preferably the wheel is located to the rear and below the torso of the person mounted on said frame.

Preferably the wheel is connected to said pedal arrangement by a drive train such that the wheel can be caused to rotate by pedalling action of the user.

Preferably the drive train causes the wheel to rotate at an approximately 3:1 ratio with the pedal arrangement.

Preferably the drive train comprises a set of sprockets connected via chains or belts.

Preferably the frame has a seat on which the user can sit during use.

Preferably the frame has handlebars which are grippable by the user.

Preferably a mechanism is provided to assist the user in moving the frame to the "wheelie" condition and maintaining the frame in the "wheelie" condition.

Preferably the mechanism is a gas strut connected between said base and said frame which is able to at least partially support the frame when it has pivoted with respect to the base.

Preferably a tether is connected between said base and said frame to restrict the extent the frame can pivot with respect to the base.

Preferably the tether is user adjustable so that the extent of pivoting of the frame with respect to the base can be adjusted.

In another aspect the present invention consists in a stationary exercise device comprising a bicycle frame that includes handlebars and a pedal drivable rear flywheel, the frame pivotally mounted at the rear wheel axle relative to a base able to be supported on the floor to allow the frame to rear up and drop down about the rear fly wheel axle, in use by the user, the frame including a seat for the user to sit on that is able to be adjusted in angle of inclination relative the frame.

Preferably the frame is pivotally mounted at or near the rear wheel axle to a floor supportable base.

Preferably the frame includes a seat for a user to sit on.

Preferably no front wheel is included.

Preferably the rear wheel is a flywheel.

Preferably the rear wheel is coupled to a flywheel.

Preferably the seat is supported by the frame at a front pivot axis and by a seat pivot controller a rear pivot axis, both of which are parallel to each other.

Preferably the seat pivot controller forms part of a 4 bar linkage system that includes the base and frame and seat.

Preferably the angle of inclination can be adjusted by a seat tilting mechanism.

Preferably the seat tilting mechanism comprises;

a least one front bar rigidly attached at one end to the frame with its other end pivotally attached to said seat at a front pivot axis; and at least one rear bar pivotally attached at one end to the seat at a rear pivot axis, the other end of the rear bar pivotally attached to the base a distance away from where the frame is pivotally mounted.

Preferably the rear bar is forked to engage to the base at locations on each side of the flywheel.

Preferably there are two rear bars.

Preferably the front and rear bars can be adjusted to adjust the height of the seat relative the floor.

Preferably the seat is pivotally and vertically supported at a front pivot axis by a front bar rigidly attached to the frame and pivotally supported at a rear pivot axis by an actuator attached to the front bar.

Preferably the adjustment of the seat height is via a sprung pin and hole type system integrated in the front and rear bars.

Preferably the actuator is part of a hydraulic system comprising an actuator and a pump fluidly connected by a conduit.

Preferably the pump is attached to a stopper a distance offset from where the frame is pivotally mounted.

Preferably the stopper is rigidly engaged to the base.

Preferably the stopper can be pivotally adjusted about the frame pivot.

Preferably the seat is pivotally and vertically supported at the front pivot axis by a front bar rigidly attached to the frame and pivotally supported at the rear pivot axis by a cable.

Preferably the cable is part of a push/pull Bowden cable system.

Preferably the other end of the cable is attached to a stopper a distance offset from where the frame is pivotally mounted.

Preferably the stopper is rigidly engaged to the base.

Preferably the stopper can be pivotally adjusted about the frame pivot.

In another aspect the present invention consists in a stationary exercise device comprising a bicycle frame that includes pedals, handlebars and a pedal drivable rear fly wheel, the frame pivotally mounted at a pivot axis in a manner so that a user can move frame to a condition where the frame is unstable in a direction rotational about said pivot axis.

Preferably said pivot axis coaxial the axis of rotation of the rear flywheel is able to be pedal driven by the user of the device.

In another aspect the present invention consists in a method of exercising comprising:

mounting the stationary exercise device as hereinbefore described, applying a force to 1. the pedal arrangement to drive the wheel, and/or
2. the frame to cause the frame to pivot relative to the base to simulate a "wheelie".

Preferably the method further comprising the step of sustaining the force applied to the pedal arrangement and/or the frame to maintain the frame in the "wheelie" position.

In another aspect the present invention consists in an exercise device substantially as herein described with reference to any one or more of the accompanying drawings.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

The invention will now be described by way of example only and with reference to the drawings in which.

DETAILED DESCRIPTION OF THE INVENTION

The present invention is a stationary exercise device that allows a user to simulate a "wheelie" manoeuvre. A "wheelie" is usually performed on a non-stationary bicycle or motorcycle. It involves the user raising the front wheel off the ground for a sustained period of time, thereby requiring the user to balance solely on the rear wheel as it travels over ground.

The stationary exercise device 1 of the present invention allows a user 2 to perform a "wheelie" while the device remains stationary. To perform a wheelie on the device 1, the user must exert themselves physically. The device may therefore be an effective exercise and/or training aid. The risk of injury due to falling during the "wheelie" is reduced because the device does not travel over ground and is constrained to a certain range of motion.

Figure 2:
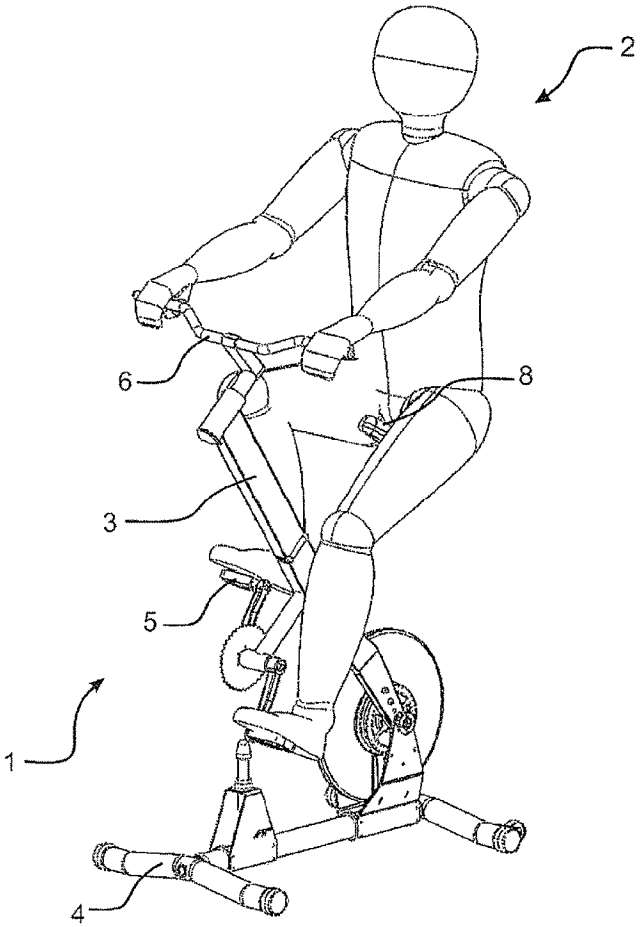
FIG. 2 shows the exercise device of FIG. 1 in a "wheelie position"
Figure 1:
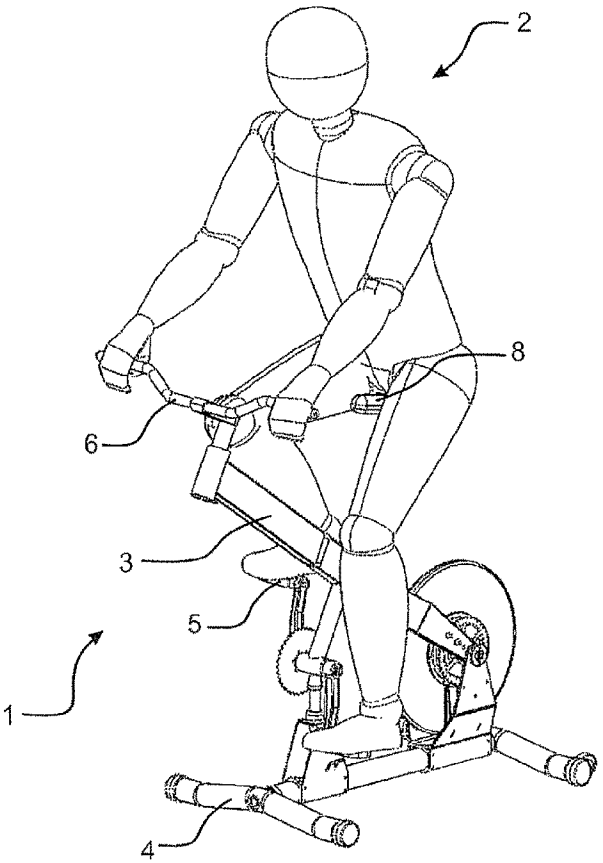
FIG. 1 shows a stationary exercise device of the present invention being used by a user.

FIG. 1 shows a user 2 on the device 1 in its neutral position, while FIG. 2 shows the user in the "wheelie" position. In both positions the user may or may not be sitting on a seat 8 and may or may be gripping a set of handlebars 6. To get to the "wheelie" position, the frame 3 of the device 1 is made to rear up by the user and rotates relative to the base 4 about a pivot. At the conclusion of the "wheelie" the frame 3 will drop down to the neutral position as shown in FIG. 1.

FIGS. 3 to 6 show the various positions of a user on the exercise device 1. FIGS. 3A and 3B show the user in the neutral position. FIGS. 4A and 4B show the user in a "wheelie" position. In this position the frame 3 of the device 1 has rotated backwardly relative to the base 4. FIGS. 5A and 5B show the user in a "wheelie" position but leaning to the left. Likewise, FIGS. 6A and 6B show the user in a "wheelie" position but leaning to the right. In use, the user can attempt to keep the device in a "wheelie" position as shown in FIGS. 4A and 4B while using their balance to avoid leaning too far to the right or left as shown in FIGS. 5B and 6B.

Figure 4A:
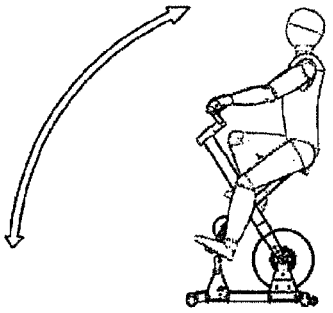
FIG. 4A shows a side view of a user of an exercise device in a second position.
Figure 4B:
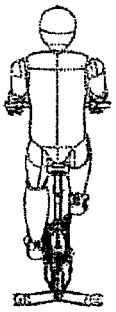
FIG. 4B shows a rear view of the exercise device of FIG. 4A.
Figure 5A:
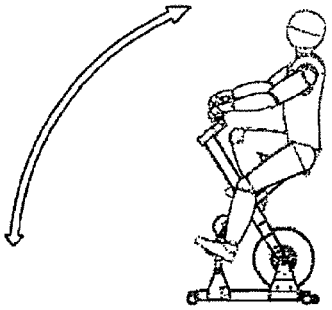
FIG. 5A shows a side view of a user of an exercise device in a third position.
Figure 5B:
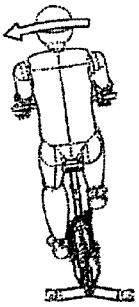
FIG. 5B shows a rear view of the exercise device of FIG. 5A.
Figure 6A:
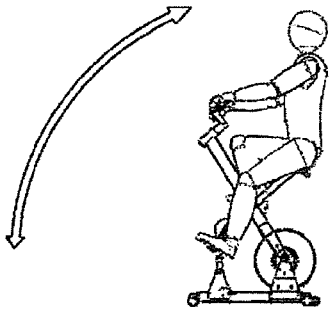
FIG. 6A shows a side view of a user of an exercise device in a fourth position.
Figure 6B:
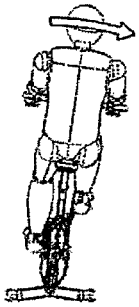
FIG. 6B shows a rear view of the exercise device of FIG. 6A.

In use, a "wheelie" is achieved by the user applying force to the pedals 5, pulling up on the handle bars 6, and transferring weight to the back of the device 1 all at the same time. This motion is shown in FIGS. 4A and 4B.

In a double axis version of the device there are two directions in which the user must control their balance—vertical (to bring the frame up and down) and lateral (left and right). To maintain the wheelie a user must adjust their weight backwards or forwards. They may also apply force to the pedals 5 and/or handle bars if the frame 3 starts to drop toward the neutral position or by applying brakes if the frame starts to rotate back to far beyond the "wheelie" position. The balance in the lateral direction is controlled by adjusting the user's body weight such as by sticking out a knee, or by turning the handlebars 6.

Figure 8:
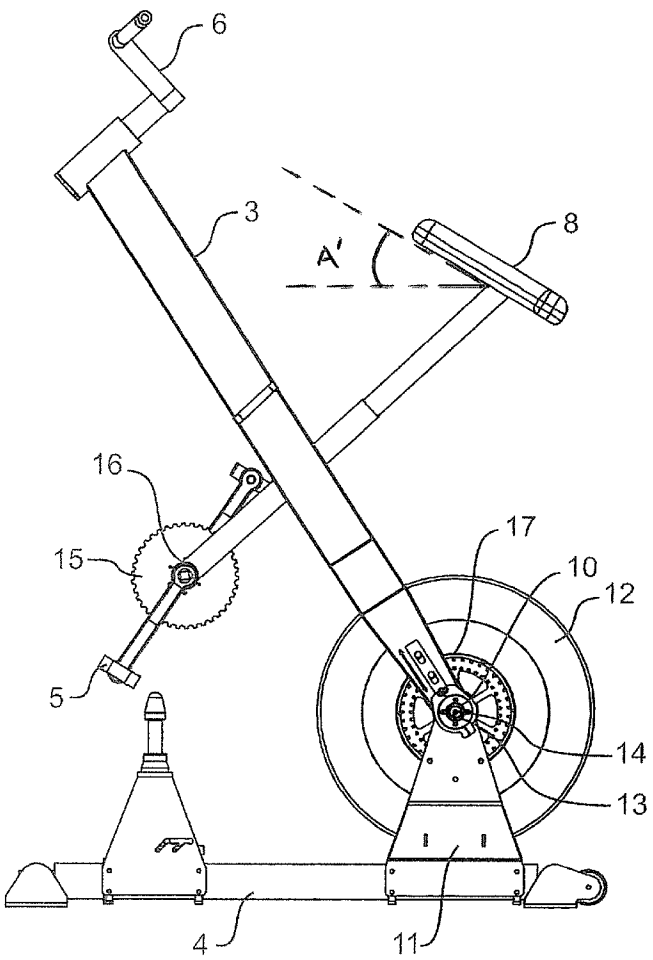
FIG. 8 shows a side view of the exercise device of FIG. 7 in a "wheelie" position.
Figure 7:
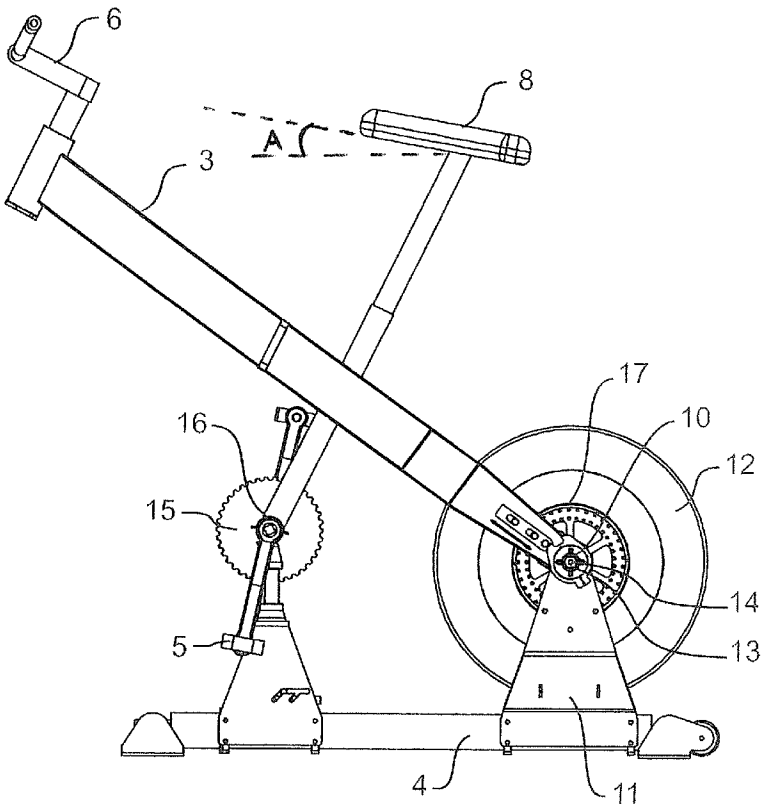
FIG. 7 shows a side view of an exercise device in the neutral position.

With reference to FIGS. 7 and 8, the frame 3 is rotatable about a rear axle 10 to allow the frame 3 to rear up (FIG. 8) and drop down (FIG. 7). As shown in the drawings, the rear axle 10 is substantially horizontal and defines a first axis 13 which is the axis of rotation of the frame 3. The rear axle 10 may be supported directly or indirectly by the base 4. In the preferred embodiment of the invention, the base 4 includes a frame supporting member 11. The frame supporting member 11 connects the frame 3 to the base 4 via the axle 10.

Figure 3A:
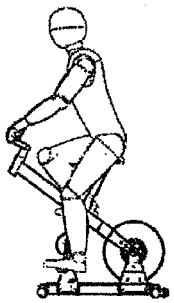
FIG. 3A shows a side view of a user of an exercise device in a first position.
Figure 3B:
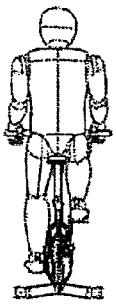
FIG. 3B shows a rear view of the exercise device of FIG. 3A.

The frame supporting member 11 may be pivotally mounted to the base 4 about a second axis which is horizontal and perpendicular to the first axis 13. This pivotal mounting allows the frame 3 to move laterally left and right relative to the base 4. This pivotal freedom will require the user to have balance to keep the frame from leaning too far to either side. The frame may be biased towards a neutral position wherein the frame is located centrally of the base 4 (e.g. as shown in FIGS. 3B and 4B). Any means of biasing the frame to the neutral position may be employed. In the preferred embodiment of the invention a leaf spring is used to bias the frame to the neutral position.

The device 1 includes a wheel 12 which is mounted to the frame 1 so that it can rotate about a wheel axis 14. The wheel axis 14 is parallel to the first axis 13. In the preferred embodiment the wheel axis 14 and the first axis are coaxial and both are defined by the axle 10.

Figure 16:
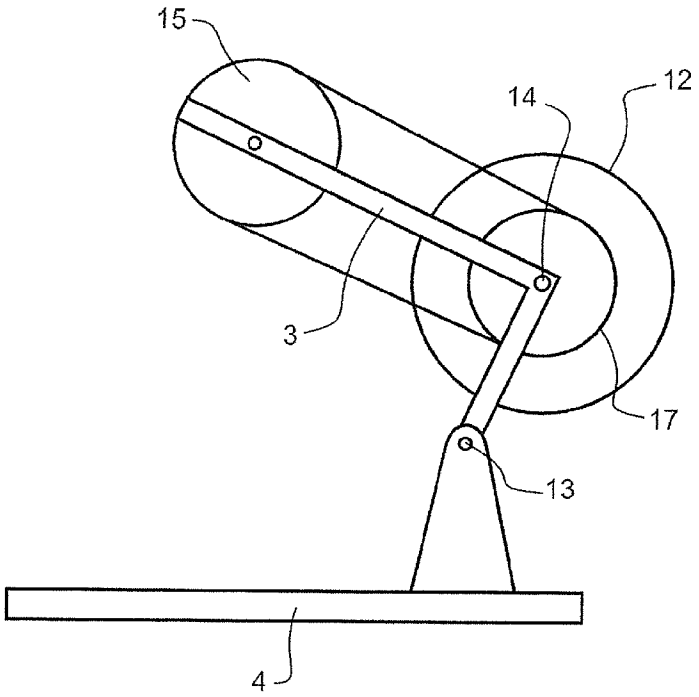
FIG. 16 shows a further alternative exercise device wherein the axes of the wheel and of frame rotation are not coaxial.
Figure 15:
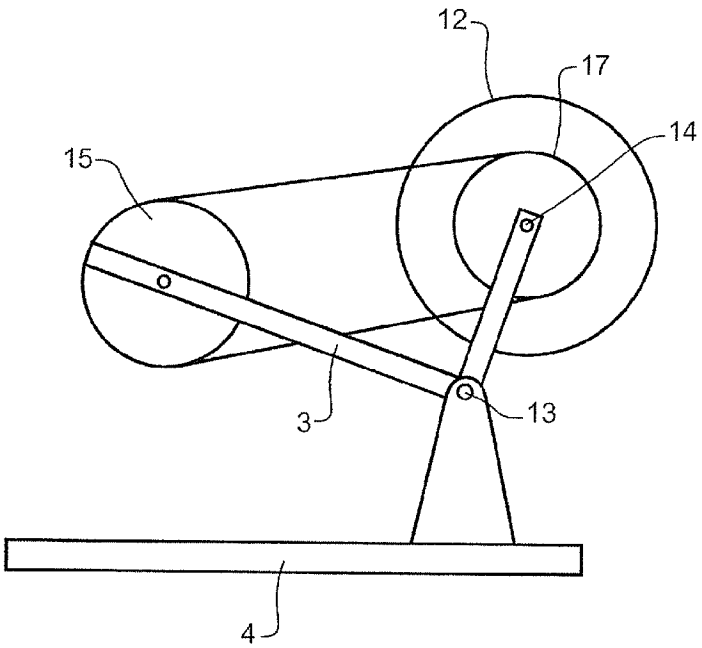
FIG. 15 shows an alternative exercise device wherein the axes of the wheel and of frame rotation are not coaxial.

It should be appreciated that the wheel axis 14 and the first axis 13 may not be coaxial. Examples of these axes being non-coaxial are shown with respect to FIGS. 15 and 16.

The device further includes a pedal arrangement 5 for driving a crank sprocket 15. The crank sprocket 15 rotates about a crank axle 16 which is parallel to the wheel axis.

In one embodiment, a chain connects the crank sprocket 15 to a wheel sprocket 17 in order to drive the wheel 12. However, it should be appreciated that any other method of transmission may be suitable as would be apparent to a person skilled in the art. Other methods of transmission may be via a belt or drive shaft for example. A preferred transmission is shown with respect to FIGS. 21 to 23.

The wheel 12 is preferably located substantially to the rear and below the torso of the user when they are positioned on the frame 3.

The wheel 12 is preferably located substantially to the rear of the crank sprocket 15, the handle bars being forward and above the crank sprocket.

Figure 11:
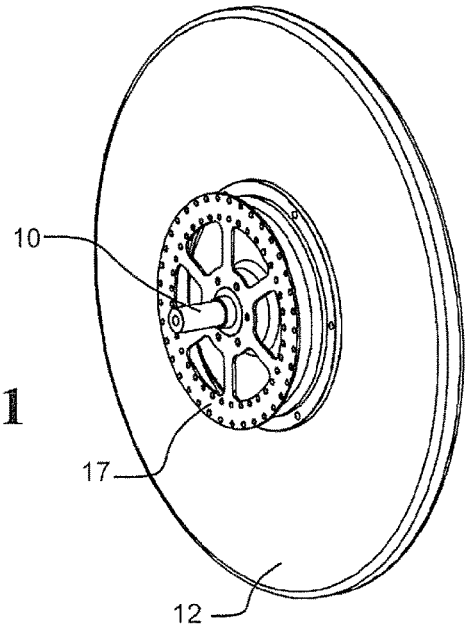
FIG. 11 shows an isometric view of the wheel assembly of FIG. 9.
Figure 9:
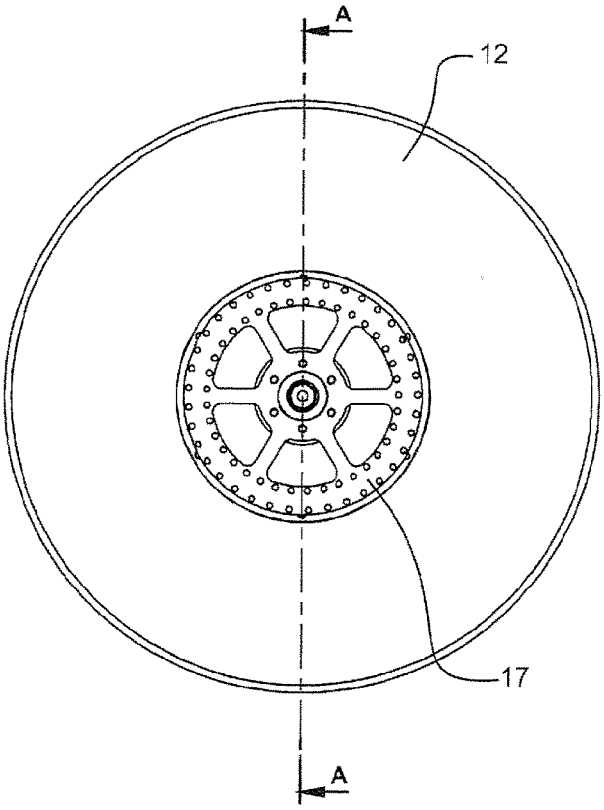
FIG. 9 shows a wheel assembly of an exercise device of the present invention and shows the location of the cross section A-A.
Figure 10:
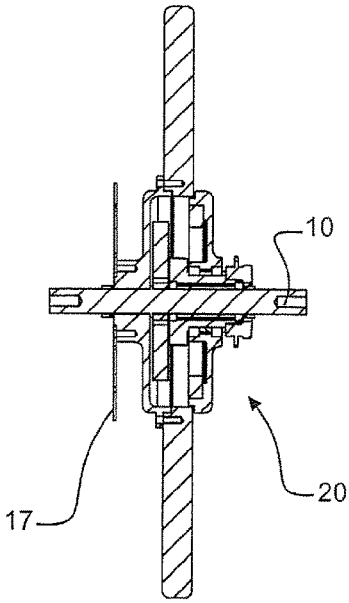
FIG. 10 shows the cross section A-A of FIG. 9.

The wheel 12 may be a flywheel as shown in FIGS. 9 to 11. A flywheel may help steady the rotation if a fluctuating torque is exerted through the pedal arrangement and transmission by the user. The flywheel is preferably circular in circumference but need not be. It is preferably balanced around its axis of rotation. It is preferably less than 800 mm in diameter and carries most of its mass at its perimeter. It is preferably heavier than 4 kg and preferably lighter than 25 kg.

In one embodiment of the invention the heavy flywheel 12 rotates up to ten times to every revolution of the pedals. Gearing such as a gearbox 20 is employed to achieve this ratio. Preferably the gearbox 20 includes a planetary gear arrangement between the rear sprocket 17 and the flywheel 12.

A brake such as a magnetic brake may be provided to act on the flywheel 12. The magnetic brake applies drag to the flywheel 12 which makes it easier for a "wheelie" to be initiated and maintained. By applying enough force to the pedal arrangement, the torque threshold at the rear axle will be reached and the crank sprocket 15 will climb up the chain, therefore rotating the frame into a "wheelie" position. Alternatively to a magnetic brake, any other means for applying drag to the flywheel may be used, e.g. a friction brake or an air brake.

In addition to a magnetic brake the device 1 may include a user operable wheel brake mechanism which can act on the wheel 12, preferably at a location away from the wheel's axis of rotation. The brake mechanism may be engaged by a user actuatable lever located on the handle bars 6. In the preferred embodiment the user actuated brake mechanism is a friction brake acting on the wheel 12. Operation of the user operable wheel brake when the device is in the "wheelie" position will cause the frame to be biased downwardly toward the ground. Therefore, if a user wants to end the "wheelie" they can engage the wheel brake to bring the frame back down to the neutral position.

The device 1 may also include means for varying the work rate of the user. A user may wish to alter the pedal resistance to change their work rate. A resistance brake mechanism may therefore be provided to apply varying about of resistance to make it easier or harder for a user to peddle. The resistance brake mechanism may be a brake on the front sprocket 15 for example. Alternatively, any other suitable method of allowing the user to alter the resistance may be employed. A rear wheel air brake may be an example.

Figure 13:
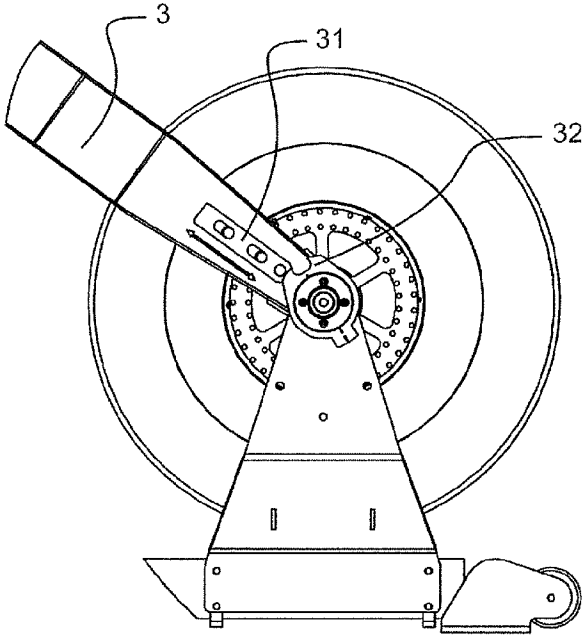
FIG. 13 shows the enlargement 'A' of FIG. 12.
Figure 12:
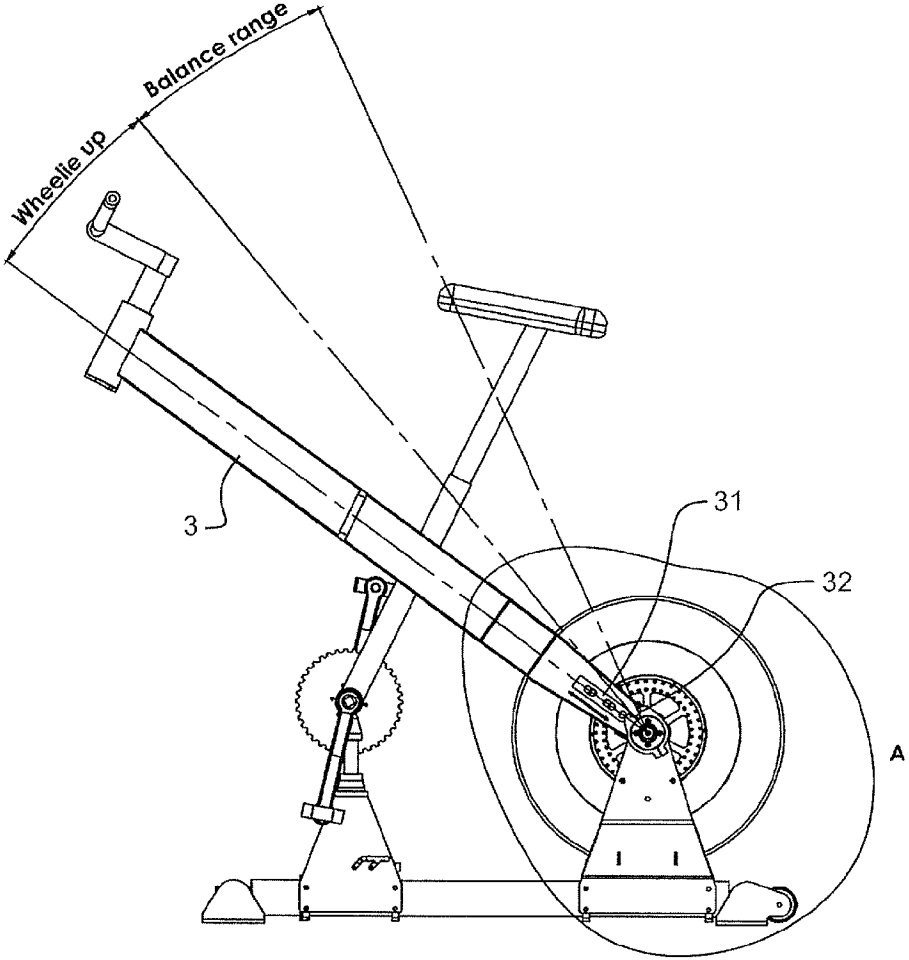
FIG. 12 shows the rotational ranges for the frame of a exercise device of the present invention and shows the location of the enlargement 'A'.
Figure 14:
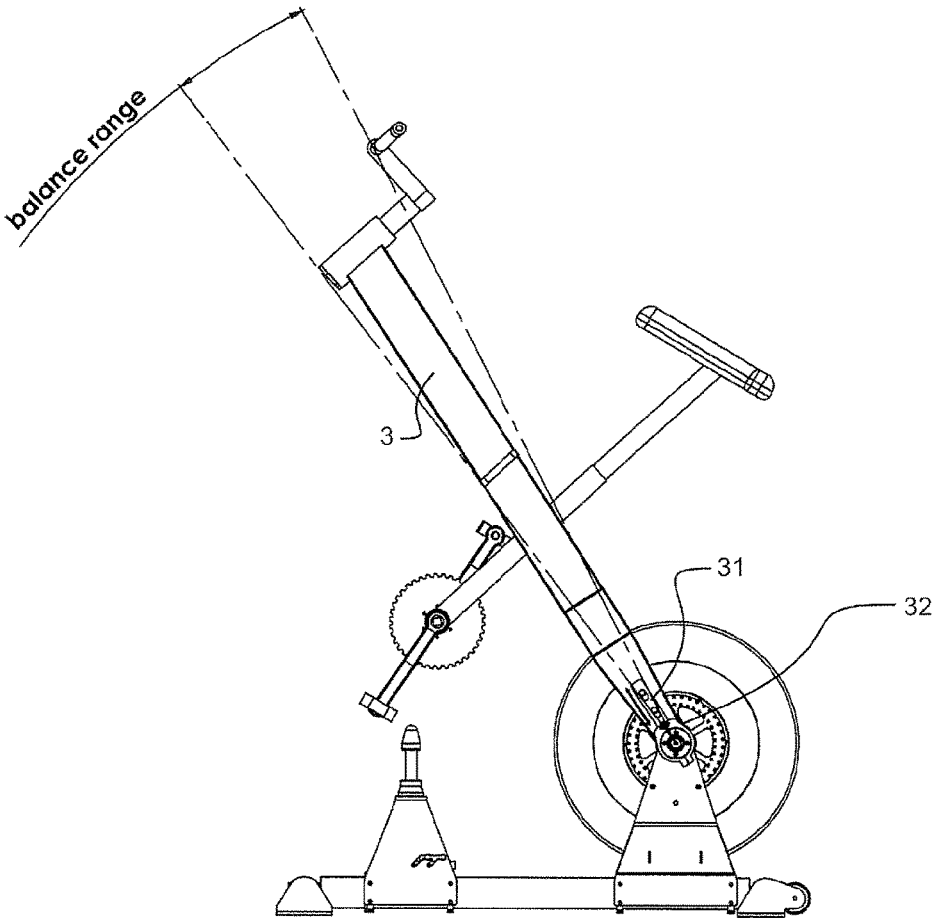
FIG. 14 shows a exercise device with the frame positioned in the balance range for performing a "wheelie"

FIG. 12 shows the device 1 in the neutral position and indicates the range of rotation for performing a "wheelie". Once the wheelie is initiated in the "wheelie up" range and the frame rotates to the "balance range", the wheelie can be easily sustained. A means for keeping the frame in the balance range may be provided. In one embodiment a rotation range limiter is provided as shown in FIGS. 12, 13 and 14. The rotation range limiter consists of a spring loaded catch 31 that engages with a slot 32 to keep the frame in the balance range. The catch 31 is spring biased towards the slot 32 so that when the frame enters the balance range it will engage with the slot 32. This is shown with reference to FIG. 14.

A catch disengagement means may be provided so that a user can disengage the catch (i.e. so that it is pulled against its bias) so that the frame can return to the neutral position as shown in FIG. 12. Alternatively, the front stand that supports the frame in the lower condition may be adjusted in height to support the frame in the "wheelie" condition.

In one embodiment of the invention, the wheel is able to "freewheel", i.e. a user can stop pedalling and the stored energy in the wheel will keep it spinning momentarily. Alternatively, the crank and the wheel may be constrained via the transmission so that "freewheeling" is not possible. In such a configuration, a user can gradually apply a backward force to the pedals to resist the stored energy in the wheel. Applying a backward force to the pedals while the frame is in a "wheelie" condition will have the effect of causing the frame to drop down to the neutral position. In yet a further configuration, a back pedal brake (also known as a foot brake or a coaster brake) may be used. A back pedal brake can be used to brake the wheel if a user applies a backward force to the pedals while allowing "freewheeling" when no backward force is applied to the pedals.

Figure 18:
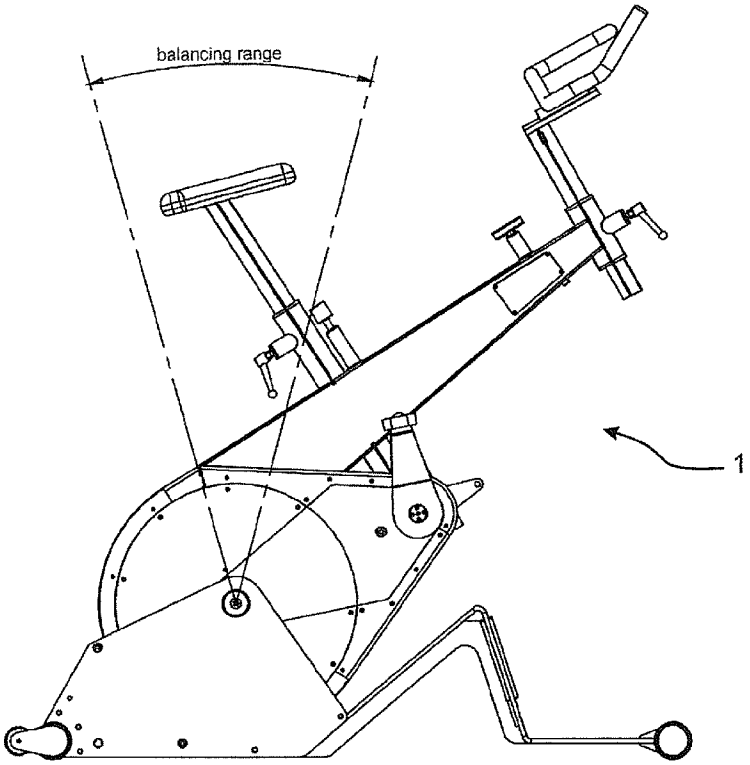
FIG. 18 shows the exercise device of FIG. 17 in the "wheelie" position.
Figure 17:
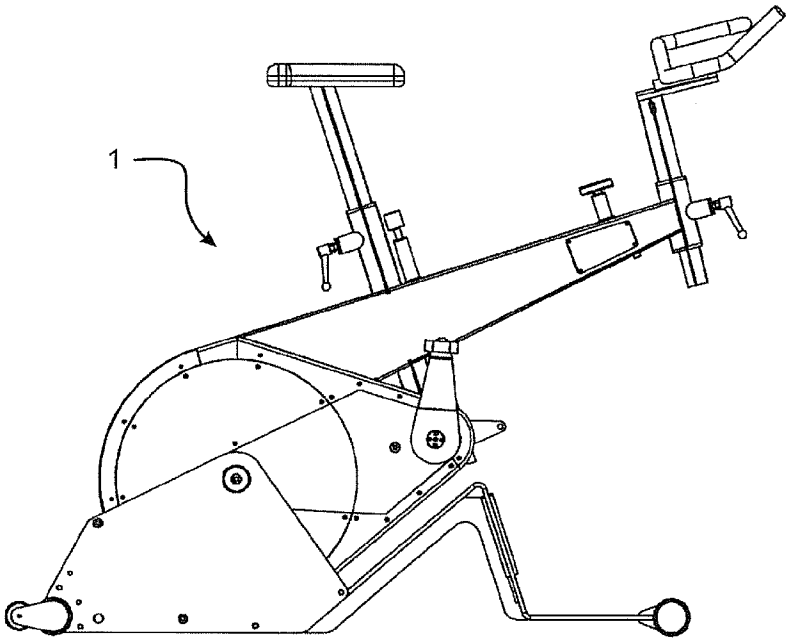
FIG. 17 shows a preferred form of the exercise device of the present invention in the lowered frame position.

FIGS. 17 and 18 show a preferred embodiment of the exercise device 1 of the present invention in two different conditions. FIG. 17 shows the exercise device 1 in the lowered frame position and FIG. 18 shows the exercise device 1 in the "wheelie" position. FIG. 18 also identifies a balancing range which is an approximate range in which the centre of gravity of the user should be located in order to keep the exercise device in the "wheelie" position.

Figure 19:
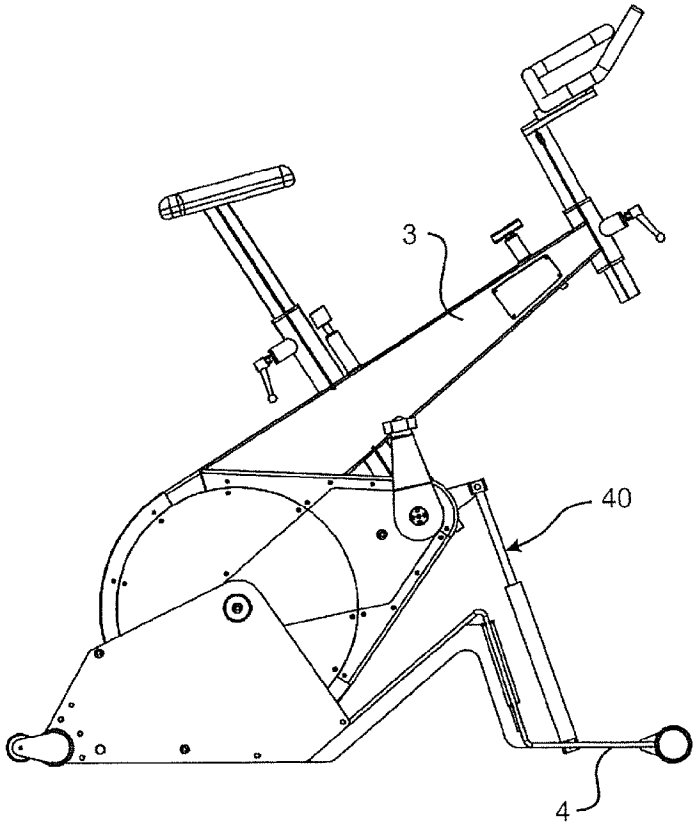
FIG. 19 shows the exercise device with a mechanism to assist a user in keeping the frame in the balancing range.

Some users may find it difficult to keep the exercise device in the balancing range as shown in FIG. 18. A mechanism 40 as shown in FIG. 19 may be provided to assist a user in pulling the frame up into the balancing range. The mechanism 40 may be a gas (or other) spring and may also act as a damper when the frame comes back down to the lower frame position. It may also act as a stop to restrict the frame from rotating too far back with respect to the base. Preferably the mechanism 40 has an adjustable spring pressure so that it can be made to be easier or harder to "wheelie" up the frame and to keep it in the balance range depending on the user's skill level. In the preferred embodiment of the invention, the mechanism 40 is a gas strut, however alternatively it may be an oil damper, counter weight or any other suitable mechanism.

Figure 20:
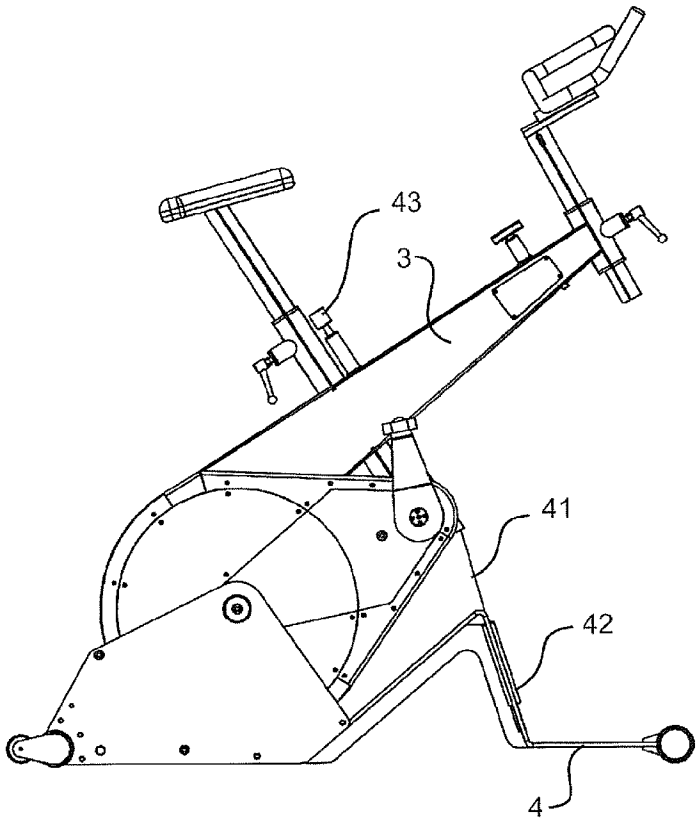
FIG. 20 shows the exercise device with a tether used to restrict the extent of rotation of the frame relative to the base, FIG. 21 show a drive train of the preferred form of the exercise device of the present invention.

As shown in FIG. 20, a tether 41 may be provided from the base 4 to connect to the frame 3. The tether may consist of a cable anchored at the frame end and with a nut on the other end. The nut is encased in the tube 42, so that it can slide up and down the tube, but is constrained so that it cannot be pulled out form the tube. This limits the rotation of the frame relative to the base. The tether may be user adjusted by adjustor 43 to alter the length of the cable. In this way the frame can be constrained so that it cannot rotate past a certain point.

Figure 21:
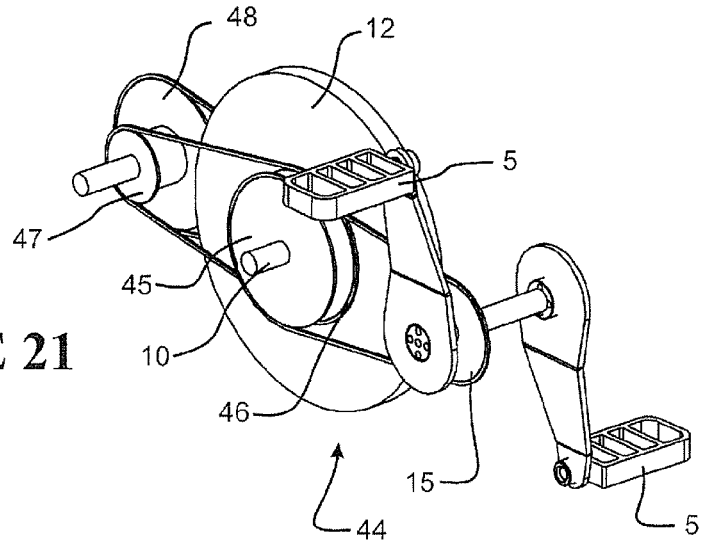
Figure 22:
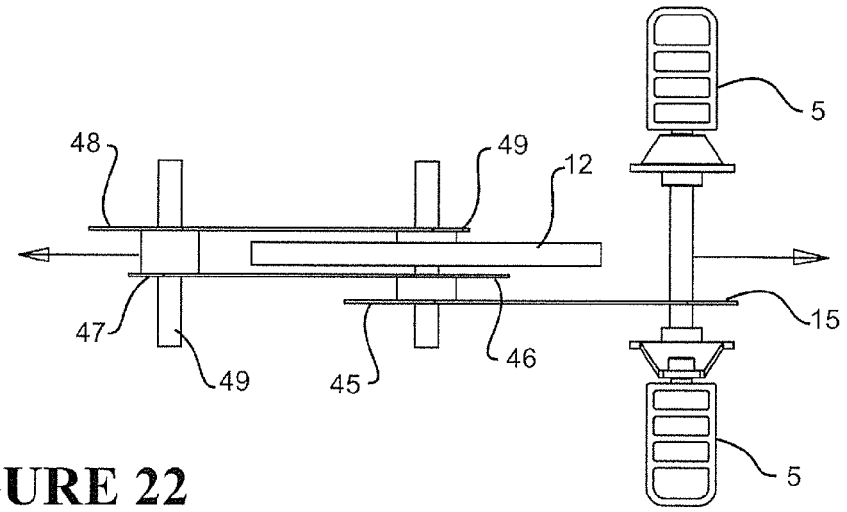
FIG. 22 shows a top view of the drive train of FIG. 21.
Figure 23:
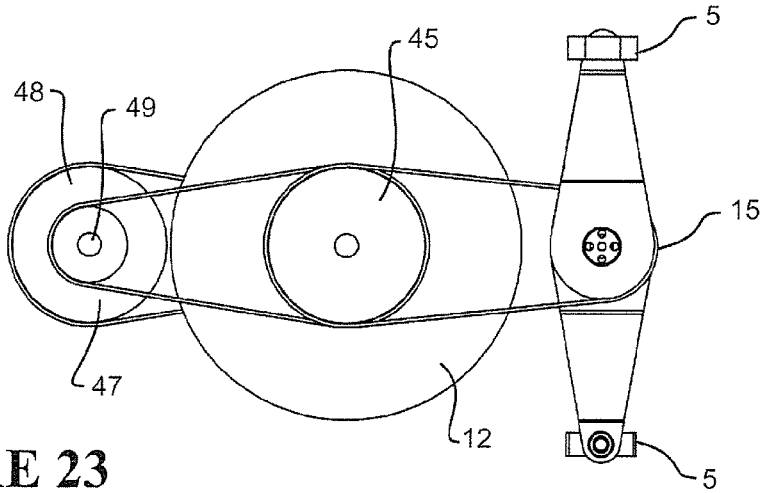
FIG. 23 shows a side view of the drive train of FIG. 21.

A preferred drive train 44 is shown with respect to FIGS. 21 to 23. The crank sprocket 15 is connected to sprocket 45 which is in a fixed engagement with sprocket 46. Sprockets 45 and 46 are able to rotate independently of axle 10. Sprocket 46 is connected to sprocket 47 which is in a fixed engagement with sprocket 48. Sprockets 47 and 48 are able to rotate about (or with) the secondary axle 49. Sprocket 48 is connected to sprocket 49 which is in a fixed engagement with the flywheel 12. Sprocket 49 and flywheel 12 are able to rotate independently of axle 10. Through this arrangement the rotational force imparted on the pedal arrangement is transferred through to the flywheel 12.

The gear ratios between the various sprockets in the drive chain are such that the flywheel 12 rotates approximately 3 times faster than the crank sprocket 15. Therefore, for every revolution of the pedals, the flywheel rotates three times. To achieve this, the driver sprockets 46 and 48 are larger than their corresponding driven sprockets 47 and 49 respectively. It should be appreciated that this is only one possible gearing arrangement and other similar gearing arrangements could be employed to achieve the desired ratio between the crank sprocket 15 and the flywheel 12.

The drive train 44 relies on belts or chains to transmit motion between the non-coaxial sprockets. This ensures there is no backlash in the drive train.

In a preferred embodiment the exercise device provided for a seat angle adjustment. A mechanism 50 can be used to keep the seat level or at a predetermined angle relative the ground between a non-wheelie position and a wheelie position. This allows the user to sit or remain substantially in the same position (other than being lifted) between the non-wheelie position and a wheelie position. Without a mechanism, it can be seen that the seat angle A increases to A' as the exercycle moves between a non-wheelie position and a wheelie position as shown in FIGS. 7 and 8.

Several seat angle adjustment mechanisms 50 are proposed. In the preferred form all proposed mechanisms 50 may also allow for the seat 8 to be adjusted in height between the crank and the top of the seat to allow for different user heights.

Figure 27:
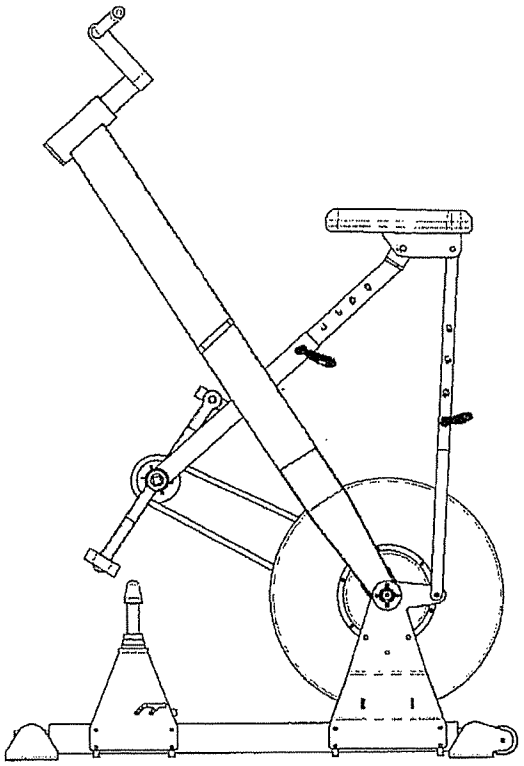
FIG. 27 shows FIG. 26 in a different position.
Figure 26:
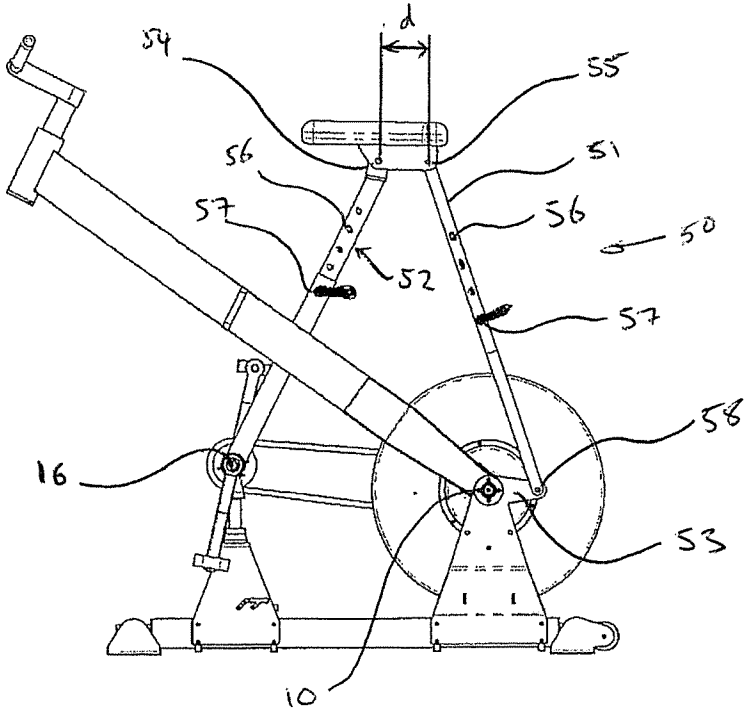
FIG. 26 shows a side view of the exercise device with a 4-bar chain like mechanism to keep the seat at a predetermined angle.

In one embodiment the seat angle mechanism 50 is comprised of a linkage mechanism. This is shown in FIGS. 26 and 27. The linkage mechanism comprises at least two bars that are pivotally attached to the underside of the seat at spaced apart pivot points 54 55. The pivot points are located on two parallel pivot axes, each axis allowing pivoting of a rear bar 51 and front bar 52. The other end of the front bar 52 is rigidly fixed to the frame 3. It provides most of the load carrying capacity of for the seat and can be likened to the seat stem. The rear bar 51 is pivotally fixed at the other end to a fixed lever 53. It acts as the pivot input for the seat. The fixed lever 53 is offset from the rear axle 10. The rear bar 51 may be a forked bar that is fixed on both sides of the rear wheel 12 and once to the seat 8. In other embodiments there are two rear bars.

The front bar pivots about the rear wheel axle 10, the rear bar 51 rotates at a pivot 58 about an offset from the rear wheel axle 10 and there is a distance d between the pivot points 54 55, this creates a 4 bar linkage system. When the frame 3 is operatively rotated, a twisting about the pivot points 54 and 55 on the seat 8 occurs, tilting the seat. The mechanism can be likened to a 4-bar-chain or 4-bar linkage mechanism. The pivots of such located at points 54, 55, 58 and 10.

The four bar linkage mechanism can be seen in FIGS. 26 and 27 wherein FIG. 26 is the exercise device at a non-wheelie position and FIG. 27 is the exercise device in a wheelie position. The seat remains at a fixed angle or sufficiently in or near the same orientation relative the ground between a non-wheelie and wheelie position.

As can be seen in FIGS. 26 and 27, each pivoting bar is extendible. Holes 56 may be provided to allow easy incremental adjustment of the seat angle or if both bars 51 52 are adjusted simultaneously then the seat height can be adjusted. To lock the seat height adjustment in place, a snap lock 57, like those used in crutches, or alternatively like bicycle seat locks can be used.

Friction locks could be used instead to allow extension and to lock the bars.

Figure 25:
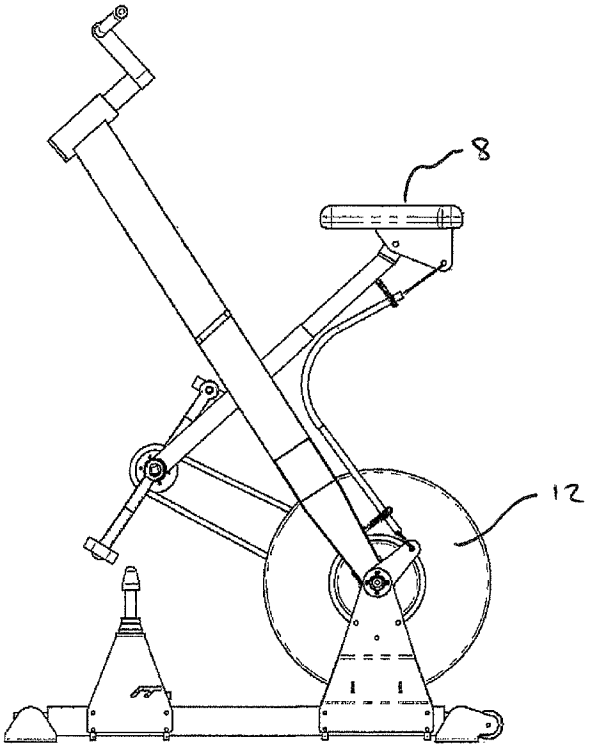
FIG. 25 shows FIG. 24 in a different position.
Figure 24:
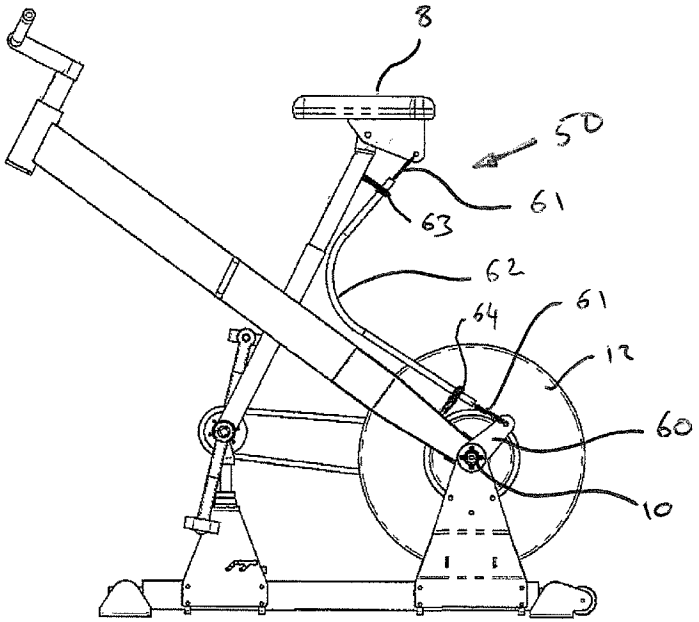
FIG. 24 shows a side view of the exercise device with pivotally mounted seat and a linkage mechanism to keep the seat at a predetermined angle relative the ground.

Alternative embodiments of the mechanism 50 include a push/pull Bowden cable system. The push-pull cable 61 is used to keep the seat angle substantially the same between a non-wheelie position and a wheelie position as shown in FIGS. 24 and 25 respectively. The push-pull cable 61 of FIGS. 24 and 25 allows for easier adjustment of the seat height compared to the 4 bar linkage mechanism. This is because the push pull cable that can adjust seat pivoting but does not affect seat pivoting if only the seat stem 52 is adjusted in height. As the exercycle pivots backwards about the rear wheel rotational axis, the push-pull cable 61 will be pushed forwards thus pushing the seat angle down and thus keeping the seat angle the same or substantially the same between the non-wheelie position and the inclined wheelie position. The further the exercycle pivots backwards, the further the seat angle is tilted down.

The push-pull cable 61 is located in a sleeve 62 that is held in place at each end by sleeve locks 63 64. The push-pull cable 61 acts like the brake cables on a bicycle. The sleeve 62 is flexible which allows the seat height to be adjusted without interfering with the seat angle.

Figure 29:
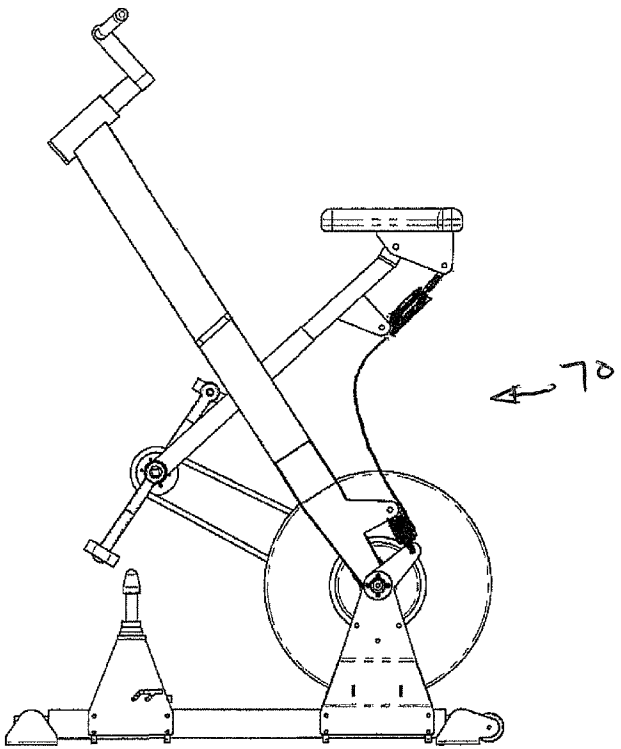
FIG. 29 shows FIG. 28 in a different position.
Figure 28:
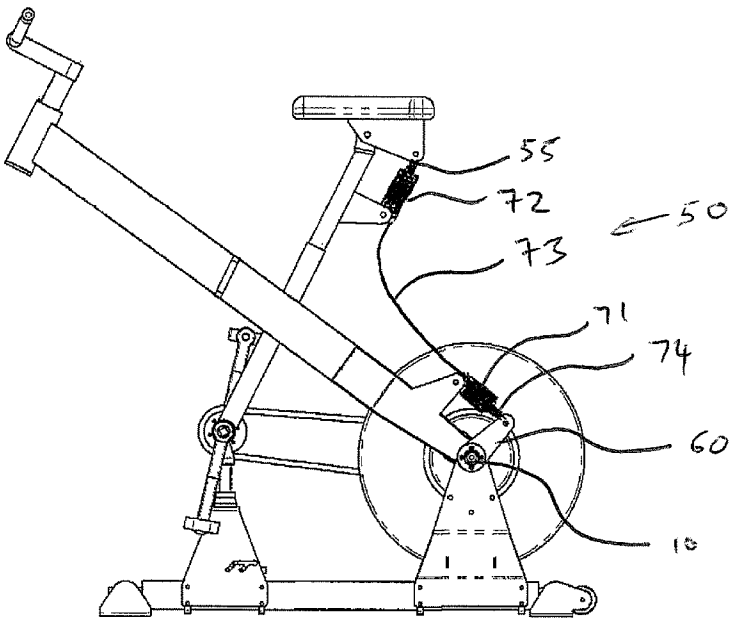
FIG. 28 shows a side view of the exercise device with a hydraulic mechanism to keep the seat at a predetermined angle.

In another embodiment the push-pull cable is replaced with a hydraulic cylinder and tube system 70 as shown in FIGS. 28 and 29. The hydraulic system 70 is used and adjusted in a similar fashion to the push pull cable mechanism. The hydraulic system comprises a pump 71 and an actuator 72. The pump 71 and actuator 72 are fluidly connected by a conduit 73. Again, like the push-pull cable system, the pump and actuator are locked into place, whilst the conduit is free to flex. A pivot lever 60 is also supplied to hold a piston 74 to pump the pump 71.

The sleeve lock 63 and actuator 72 in their respective embodiments must be attached to the sliding seat stem 52, and not to the fixed seat stem. When the seat height is adjusted, the distance between the rear pivot point 55 and seat sleeve 63/actuator 72 does not change. This is essential to keeping a constant seat angle in embodiments where the seat height can be adjusted.

The sleeve lock 63 and actuator 72 need to able to pivot on their front bar 52 fixtures, to allow for the tilting of the front bar 52 relative to the seat 8. However the cable system may not need to pivot if the cable is flexible enough to compensate for the change in angle.

In one option, the angle of the seat 8 can be adjusted manually. This may for example be achieved by a mounted adjustable pivot lever 60 mounted on the frame 3 near or at the rear wheel rotational axis 10. Moving the pivot lever 60 upwards, pushes the seat angle down and moving the pivot lever 60 downwards moves the seat angle upwards with respect to the front of the seat 8 and the ground. Once adjusted correctly, the pivot lever 60 can be fixed in place. This can be achieved a simple tightening of a nut, or a snap lock type adjustment. It is envisaged that many options for locking the pivot arm in place can be used. Adjusting the length of the pivot lever 60 will alter how much the seat angle changes with respect to how much the frame 3 pivots. An ideal pivot lever 60 length will cause the seat angle to stay substantially the same as the frame 3 pivots.

When the exercycle is tilting back, the pump 71 near the rear wheel acts as a pump (like a syringe) to actuate the actuator 72 underneath the seat 8 to push out the actuator 72 piston and tilt the seat forward. When the exercycle is tilting forward, the pump 71 acts as a pump (like a syringe) in reverse to actuate the actuator 72 piston underneath the seat to pull in and to tilt the seat back.

In both the hydraulic and the push pull cable mechanism embodiments the members between the seat and the rear fly wheel are flexible to allow tolerance for seat height adjustment.

The seat angle mechanism could be described as a passive system that could work without user input to keep the seat angle substantially the same between a lowered and raised position of the exercise device. Alternatively an active seat angle adjustment mechanism could be used. This may involve direct user input to adjust the seat angle relative the frame, such as by use of a hydraulic ram, screw thread, servo motor etc. It may also happen automatically by use of tilt sensing technology that can electronically control a seat angle adjustment mechanism.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

The invention claimed is:

1. A user mountable stationary exercise device comprising, a base configured to be supported by a floor, a frame pivotally supported by the base such that the frame can pivot relative to the base about a pivot axis, between a) a lowered frame condition wherein the frame is vertically supported at said pivot axis and at one other location on the base and b) a "wheelie" condition where the frame is supported only at said pivot axis, a user actuated pedal arrangement supported by the frame and operatively connected to drive a flywheel that has a rotational axis coaxial with said pivot axis, and a seat to support a user that remains at a substantially constant angle relative to the base, by a seat tilting mechanism, when the frame is pivoted, wherein, in use, a user may mount said frame and apply force to (1) the pedal arrangement to drive said flywheel, and (2) the frame to cause the frame to pivot relative to the base about said pivot axis.

2. The stationary exercise device of claim 1 wherein the one other location is forward of the seat.

3. The stationary exercise device of claim 1 wherein the pivot axis is horizontal and allows the frame to rear up and drop down relative to said base.

4. The stationary exercise device of claim 3 wherein the flywheel is mounted by said frame to rotate about the rotational axis.

5. The stationary exercise device of claim 1 wherein the flywheel has a perimeter distal from its rotational axis at where the flywheel mass is distributed.

6. The stationary exercise device of claim 1 wherein the flywheel has a perimeter distal from its rotational axis at where a mass is distributed.

7. The stationary exercise device of claim 1 wherein the flywheel has a perimeter distal from its rotational axis at where a mass of at least 4 kg is distributed, the perimeter not being more than 400 m from the rotational axis.

8. The stationary exercise device of claim 1 wherein the seat is pivotally mounted at a seat mount of the frame.

9. The stationary exercise device of claim 8 wherein the seat mount is a seat stem and said seat is pivotally mounted at a distal end of said seat stem.

10. The stationary exercise device of claim 8 wherein a seat pivot controller is provided to cause the seat to pivot relative the seat mount when the frame is caused to pivot relative to the base about said pivot axis.

11. The stationary exercise device of claim 10 wherein the seat pivot controller adjusts the seat angle relative the frame as a result of relative rotation of the frame to the base.

12. The stationary exercise device of claim 10 wherein the seat pivot controller operatively extends between the base at a location away from the pivot axis and the seat at a location away from where the seat is pivotally mounted to said seat mount.

13. The stationary exercise device of claim 10 wherein the seat pivot controller forms part of a 4 bar linkage mechanism operative between the seat, frame and base to passively adjust the angle of the seat relative the frame dependent on angle between the frame and the base.

14. The stationary exercise device of claim 10 wherein the pivot controller comprises a bar that extends between and is pivotally connected to the seat at one end and the frame at the other end.

15. The stationary exercise device of claim 14 wherein the bar is able to be adjusted in length.

16. The stationary exercise device of claim 9 wherein the seat stem is able to be adjusted in length.

17. The stationary exercise device of claim 10 wherein the pivot controller comprises a push/pull Bowden cable system.

18. The stationary exercise device of claim 10 wherein the pivot controller comprises an actuator coupled between said seat and said frame.

19. The stationary exercise device of claim 18 wherein the pivot controller also comprises an actuator coupled between said frame and said base and is operatively connected to said first mentioned actuator to cause it to move dependent on movement between the frame and the base.

20. The stationary exercise device of claim 1 wherein the seat is pivotally mounted relative said frame, the seat passively adjusted in angle relative the frame by virtue of a 4 bar linkage mechanism operative between the seat, frame and base.

21. A stationary exercise device comprising a bicycle frame that includes handlebars and a pedal drivable rear flywheel, the frame pivotally mounted at a rear flywheel axle relative to a base configured to be supported on a floor and pivotable between a) a lowered frame condition wherein the frame is vertically supported at said rear flywheel axle and at one other location on the base and b) a "wheelie" condition where the frame is supported only at said rear flywheel axle to allow the frame to rear up and drop down about the rear flywheel axle, in use by the user, the frame including a seat for the user to sit on that is configured to be adjusted in angle of inclination relative the base and kept at substantially that angle during movement of the frame.

22. The stationary exercise device of claim 21 wherein no front wheel is included.

23. The stationary exercise device of claim 21 wherein the seat is supported by the frame at a front pivot axis and by a seat pivot controller at a rear pivot axis, both axes of which are parallel to each other.

24. The stationary exercise device of any of the claim 23 wherein the seat pivot controller forms part of 4 bar linkage system that includes the base and frame and seat.

25. The stationary exercise device of claim 21 wherein the angle of inclination can be adjusted by a seat tilting mechanism.

26. The stationary exercise device of claim 25 wherein the seat tilting mechanism comprises;

a. at least one front bar rigidly attached at one end to the frame with its other end pivotally attached to said seat at a front pivot axis; and b. at least one rear bar pivotally attached at one end to the seat at a rear pivot axis, the other end of the rear bar pivotally attached to the base a distance away from where the frame is pivotally mounted.

27. The stationary exercise device of claim 26 wherein the rear bar is forked to engage to the base at locations on each side of the flywheel.

28. The stationary exercise device of claim 26 wherein there are two rear bars.

29. The stationary exercise device of claim 26 wherein the front and rear bars can be adjusted to adjust the height of the seat relative to the floor.

30. The stationary exercise device of claim 21 wherein the seat is pivotally and vertically supported at a front pivot axis by a front bar rigidly attached to the frame and pivotally supported at a rear pivot axis by an actuator attached to the front bar.

31. A stationary exercise device comprising a bicycle frame that includes pedals, handlebars and a pedal drivable rear flywheel, the frame pivotally mounted at a pivot axis on a base in a manner so that a user can move the frame from a lowered frame condition wherein the frame is vertically supported about said pivot axis and at one other location on the base to a condition where the frame is supported only at said pivot axis and is unstable in a direction rotational about said pivot axis said pivot axis coaxial the axis of rotation of the rear flywheel which is able to be pedal driven by the user of the device, the user able to be supported by a seat mounted to the frame that remains at a substantially constant angle relative to the base, when the frame is moved, by a seat tilting mechanism.

* * * * *